US007703618B2

(12) United States Patent
Derrien

(10) Patent No.: US 7,703,618 B2
(45) Date of Patent: Apr. 27, 2010

(54) THERMOPLASTIC MATERIAL CONTAINER, IN PARTICULAR BOTTLE

(75) Inventor: Mikaël Derrien, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 134 days.

(21) Appl. No.: 11/664,598

(22) PCT Filed: Sep. 27, 2005

(86) PCT No.: PCT/FR2005/002392

§ 371 (c)(1),
(2), (4) Date: Apr. 4, 2007

(87) PCT Pub. No.: WO2006/037872

PCT Pub. Date: Apr. 13, 2006

(65) Prior Publication Data

US 2008/0035601 A1 Feb. 14, 2008

(30) Foreign Application Priority Data

Oct. 5, 2004 (EP) ..... 04292359

(51) Int. Cl.
*B65D 1/02* (2006.01)

(52) U.S. Cl. ..... 215/375; 215/376; 220/606

(58) Field of Classification Search ..... 215/373, 215/376, 375; 220/605, 606, 608, 609; D9/520
See application file for complete search history.

(56) References Cited

U.S. PATENT DOCUMENTS

| | | | | | |
|---|---|---|---|---|---|
| 3,403,804 | A | * | 10/1968 | Colombo | 215/45 |
| 3,598,270 | A | | 8/1971 | Adomaitis et al. | |
| 4,850,494 | A | * | 7/1989 | Howard, Jr. | 215/375 |
| 5,261,543 | A | * | 11/1993 | Ugarelli | 215/375 |
| 5,353,954 | A | * | 10/1994 | Steward et al. | 220/608 |
| 5,507,402 | A | * | 4/1996 | Clark | 215/375 |
| D370,178 | S | * | 5/1996 | Petre et al. | D9/520 |
| 5,549,210 | A | * | 8/1996 | Cheng | 215/375 |
| D402,896 | S | * | 12/1998 | Conrad | D9/543 |
| 5,850,932 | A | * | 12/1998 | Beck et al. | 215/375 |
| 5,906,286 | A | * | 5/1999 | Matsuno et al. | 215/375 |
| 6,276,546 | B1 | * | 8/2001 | Davis et al. | 215/375 |
| 6,536,619 | B2 | * | 3/2003 | Gaydosh et al. | 215/375 |
| 6,571,977 | B2 | * | 6/2003 | Goncalez et al. | 220/506 |
| 2003/0006208 | A1 | * | 1/2003 | Cheng et al. | 215/375 |
| 2003/0132190 | A1 | * | 7/2003 | Zhang | 215/375 |

FOREIGN PATENT DOCUMENTS

| | | | | |
|---|---|---|---|---|
| EP | 0 440 964 | A | | 8/1991 |
| JP | 07 132925 | A | | 5/1995 |
| WO | WO 98/28193 | A | | 7/1998 |
| WO | WO 00/07886 | | * | 2/2000 |
| WO | WO 00/07886 | A | | 2/2000 |

* cited by examiner

*Primary Examiner*—Sue A Weaver
(74) *Attorney, Agent, or Firm*—Sughrue Mion, PLLC

(57) ABSTRACT

A container, in particular a bottle, made of thermoplastic material produced by blow molding or stretch-blow molding of a heated preform, the container designed to contain a liquid being flat and having a substantially domed base with outward-facing cavity defining a substantially planar peripheral annular seat for being set on a support, the base being provided with several grooves radiating from the base center. Each groove in its zone of intersection with the annular seat, has a portion of substantially increased width and the two edges of that portion of the groove are curved with relatively large radii of curvature and with respective concavities facing one another.

18 Claims, 2 Drawing Sheets

THERMOPLASTIC MATERIAL CONTAINER, IN PARTICULAR BOTTLE

FIELD OF THE INVENTION

The present invention relates to improvements made to thermoplastic containers, in particular bottles, manufactured by blow molding or stretch-blow molding a heated preform and more specifically to those of these containers which are intended to contain a still liquid and which have a substantially domed base with outward-facing concavity defining a substantially planar peripheral angular seating in order for them to rest on a support, said base being provided with several grooves radiating from the center.

DESCRIPTION OF THE PRIOR ART

Manufacturers express the constant wish to produce such containers under the most economical conditions possible, that is to say with minimum consumption of energy (essentially electrical energy) and of compressed air and with increased production rates, and also with a minimum amount of starting material.

The use of a reduced amount of starting material results in containers having very thin walls which it is necessary to mechanically reinforce with grooves. This is thus also the case with the base, which not only is produced domed with outward-facing concavity but in addition has to be reinforced by grooves or reliefs of other shapes which are generally of radiating span, in particular radial span, for containers of round general shape. Moreover, in order to mechanically reinforce the seating of the base and to ensure that it does not deform, in order for it to remain substantially flat, it is known for some at least of the radiating grooves of the base to extend over the heel of the base (that is to say, over the peripheral part of the base which is turned up in order to provide the junction with the body of the container), said grooves then cutting a notch in the seating.

A large part of the energy consumption used for the operation of a plant for the manufacture of containers of the targeted type is employed in the production of pressurized air (high pressure, of the order of $40\times10^5$ Pa, for the blow molding, medium pressure for the preblowing) and research is currently concerned with machines arranged for blow molding containers under a significantly lower pressure, for example of the order of 20 to $25\times10^5$ Pa, in conjunction with blow-molding rates which are as high as possible.

However, a low blow-molding pressure such as has just been mentioned certainly makes it possible to correctly shape the thermoplastic in the parts of the final container which are simple in shape but proves to be inadequate for correctly shaping systematically the parts which are complex in shape. This is thus in particular the case with the seating of the base, in which the grooves exhibit a double curvature (transverse curvature of the groove, curvature of the groove in its radiating span for the crossing of the seating) which combines with the curvilinear general shape of the seating (which is round in a container which is generally a cylinder of revolution). A malformation can thus appear in the groove at the crossing of the seating (for example, the edges of the groove tend to diverge from one another, possibly in combination with an uneven shape of one edge or of both edges).

Some manufacturers do not accept such malformations, even if the latter do not affect the stability of the containers and although, being situated on the base of the containers, they remain virtually invisible to the users of the containers.

BRIEF DESCRIPTION OF THE INVENTION

It is thus essentially an object of the invention to provide containers of improved design which can be blow molded at a high rate under a relatively low pressure, such as, for example, 20 to $25\times10^5$ Pa, while being correctly shaped, including in their parts which are complex in shape, such as the portions of the grooves of the base which combine with the seating of the base.

For these purposes, a container as mentioned in the preamble is characterized, being arranged in accordance with the invention, in that each groove, in its region of intersection of the annular seating, has a portion of substantially increased width and in that the two edges of this portion of the groove are curves with relatively large radii of curvature and with respective concavities facing one another.

By virtue of this provision, the presence of the portion of substantially increased width provides the stream of softened thermoplastic with the space necessary for its development during the blow-molding process. This stream of thermoplastic can thus follow its natural route in a controlled way, so that the previous malformations resulting from the difficulties encountered by the stream of material in its expansion are found to be prevented. It thus becomes possible to obtain, with a reduced blow-molding pressure applied for a brief interval of time, containers having a base exhibiting a correct conformation, even in the parts thereof which are complex in shape. It is thus possible to envisage blow-molding pressures reduced by 30 to 40% (for example, typically of the order of 20 to $25\times10^5$ Pa) in comparison with the blow-molding pressures generally employed (for example, typically of the order of $40\times10^5$ Pa), this being the case with a high blow-molding rate.

Moreover, the greater ease of expansion offered to the stream of material during the blow molding allows the treatment of a material which has been less softened than conventionally, in other words a material brought to a lower temperature, for example lower by 5 to 20%, than the temperature generally employed.

Under these conditions, the implementation of the provisions in accordance with the invention can result in significant energy and thus financial savings.

In addition, as regards a specific conformation given to grooves which in any case are present on the base of the containers, the additional expenditure due to the implementation of the invention remains modest.

Preferably, the best results due to the arrangement in accordance with the invention are obtained when the outer end of the region possessing increased width extends as far as onto the heel of the base.

In one embodiment of the invention, the two curved edges delimiting the portion of increased width gradually approach one another at an acute angle.

It can be arranged for the portion of each groove adjoining, from the side of the center of the base, said portion of increased width to have substantially rectilinear and substantially parallel edges. However, the best results seem to be obtained when the portion of each groove adjoining, from the side of the center of the base, said portion of increased width has a variable width and when its edges are curves possessing respective convexities facing in the direction of one another.

Still for the purpose of optimizing the results provided by the provisions in accordance with the invention, it is desirable for the edges of the portion adjoining, from the side of the center of the base, said broadened portion to join up continuously and smoothly with the respective edges of the broadened portion.

In a concrete embodiment, each groove has a depth which is substantially constant from its central origin as far as approximately the seating, then a depth which is reduced in its part of maximum width and, finally, a depth which gradually decreases in its end part on the heel of the base.

Preferably, in practice, the dimensional ratio of the widest part to the narrowest part of each groove is between 1.5 and 2.5, preferably approximately 2.

The provisions in accordance with the invention can be applied in all types of thermoplastic containers, in particular bottles, appropriate for containing a still liquid, in particular for bottles intended to contain still table water. In particular, in a very common case, the base of the container is of round general shape (the container having the general shape of a cylinder of revolution) and the grooves then extend radially.

It should be emphasized that the provisions in accordance with the invention are preferably targeted at all the grooves with which the base of a container may be provided. However, at least for certain specific applications, it can be envisaged that only some grooves should be arranged in accordance with the invention while other grooves positioned between them should not be arranged in accordance with the invention.

BRIEF DESCRIPTION OF THE DRAWINGS

The invention will be more fully understood on reading the detailed description which follows of some preferred embodiments, which are given solely as examples in no way limiting. In this description, reference is made to the appended drawings, in which.

DETAILED DESCRIPTION OF THE INVENTION

In the following description, reference is more particularly made, by way of example, to a container with the general shape of a cylinder of revolution, such as a bottle, it being understood, however, that the use of the invention is not limited to just this type of container and can relate to containers having other shapes and in particular a polygonal (in particular square or rectangular) shape.

It should also be emphasized that the provisions of the invention relate exclusively to containers which have to contain still liquids (that is to say, noncarbonated liquids) and more specifically, although not exclusively, to bottles intended to contain still water intended in particular for drinking.

Figure 1:
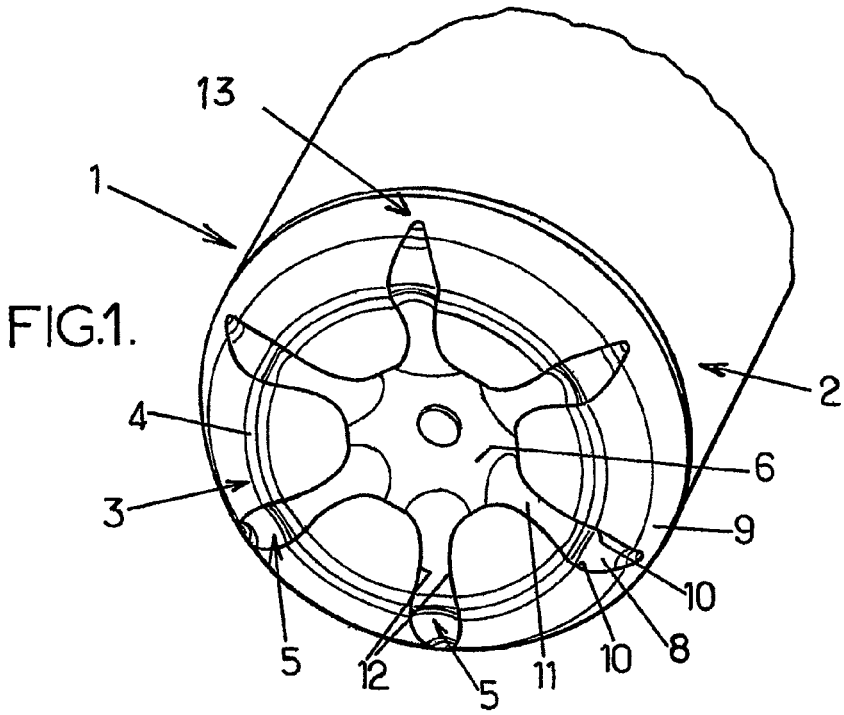
FIG. 1 is a perspective view showing the base of a thermoplastic container, in this instance a thermoplastic bottle, arranged in accordance with a preferred embodiment of the invention.
Figure 2:
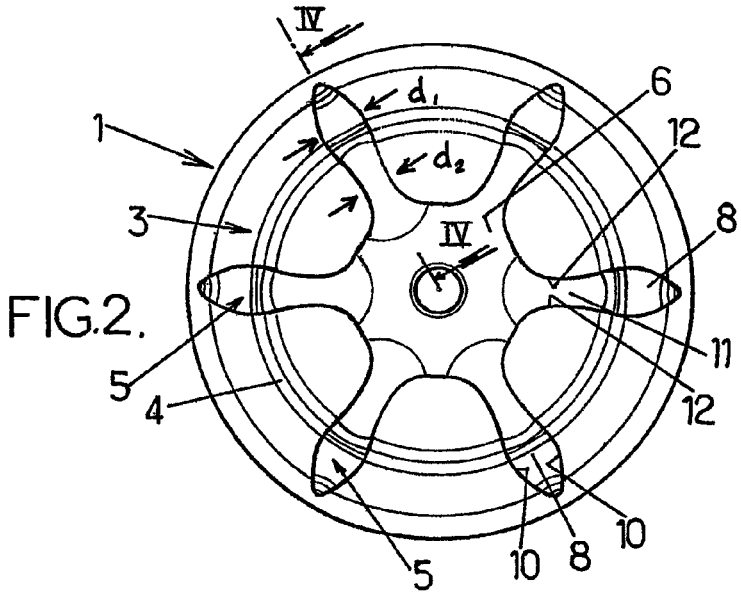
FIGS. 2 and 3 are bottom and side views respectively of the bottle of FIG. 1.
Figure 3:
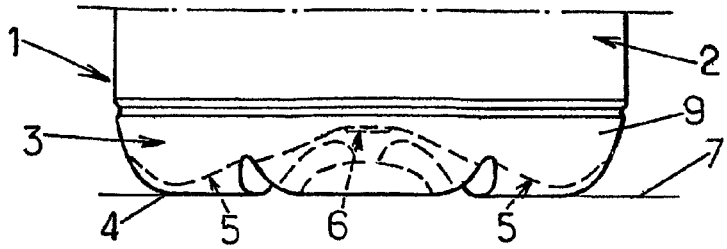

FIGS. 1 to 3 give a partial representation of a container 1, in this instance a bottle made of thermo-plastic, such as PET, and manufactured by blow molding or stretch-blow molding a preform heated beforehand to the softening temperature of the thermoplastic. The bottle comprises a body 2 (partially visible only) which joins up on its lower part with a base 3. Commonly, for bottles intended to contain still liquids and in particular still water, the base 3 is substantially domed with an outward-facing concavity, as is better seen in FIGS. 1 and 3, and it defines a substantially planar peripheral annular (in this instance circular) seating 4 in order for the bottle to rest in a stable fashion on a support 7. Commonly again, the base 3 is provided with grooves 5 which radiate, in this instance radially, from a central indentation 6 and which mechanically stiffen the base 3 so that the seating 4 remains flat despite the weight of the column of liquid which lies on top of the base 3.

In order to prevent malformations of the grooves 5 where they pass through the seating 4, provision is made, in accordance with the invention, for each groove 5, in its region of intersection with the seating 4, to have a portion 8 of substantially increased width defined by a curvilinear outline. Preferably, as visible in FIGS. 1 to 3, the outer end of said portion 8 possessing increased width extends as far as onto the heel 9 of the base 3 (the term of heel denoting the part of the base 3 which is turned up to connect with the body 2). Furthermore, the two edges 10 defining this portion 8 of the groove 5 are curves with relatively large radii of curvature and with respective concavities facing one another; advantageously, these two curved edges 10 approach one another on the outer side at an acute angle 13.

By virtue of this arrangement, a region of expansion is created in which, during the shaping of the container 1 by blow molding or stretch-blow molding, the moving stream of softened material can freely spread out and which faithfully matches the desired outline, despite the double curvature presented by this region of the groove.

It is possible to provide for the portion of each groove adjoining, from the side of the center of the base, said portion 8 possessing increased width to have substantially rectilinear and substantially parallel edges, in other words to exhibit a common conformation.

However, in order to facilitate the movement of the stream of material and to best improve the conformation of the groove in this region, it has proved to be desirable for, in addition, as illustrated in FIGS. 1 to 3, the portion 11 of each groove 5 adjoining, from the side of the center of the base, said portion 8 possessing increased width to have a variable width and for its edges 12 to be curves possessing respective convexities facing in the direction of one another. In this case, it is preferable to arrange for the edges 12 of the portion 11 adjoining, from the side of the center of the base, said broadened portion 8 to join up continuously and smoothly with the respective edges 10 of the broadened portion 8. Each groove 5 then has a continuously curvilinear outline. In the concrete embodiment visible in FIGS. 1 and 2, the dimensional ratio of the widest part $d_1$ to the narrowest part $d_2$ of each groove 5 is between 1.5 and 2.5 and is typically approximately 2.

Figure 4:
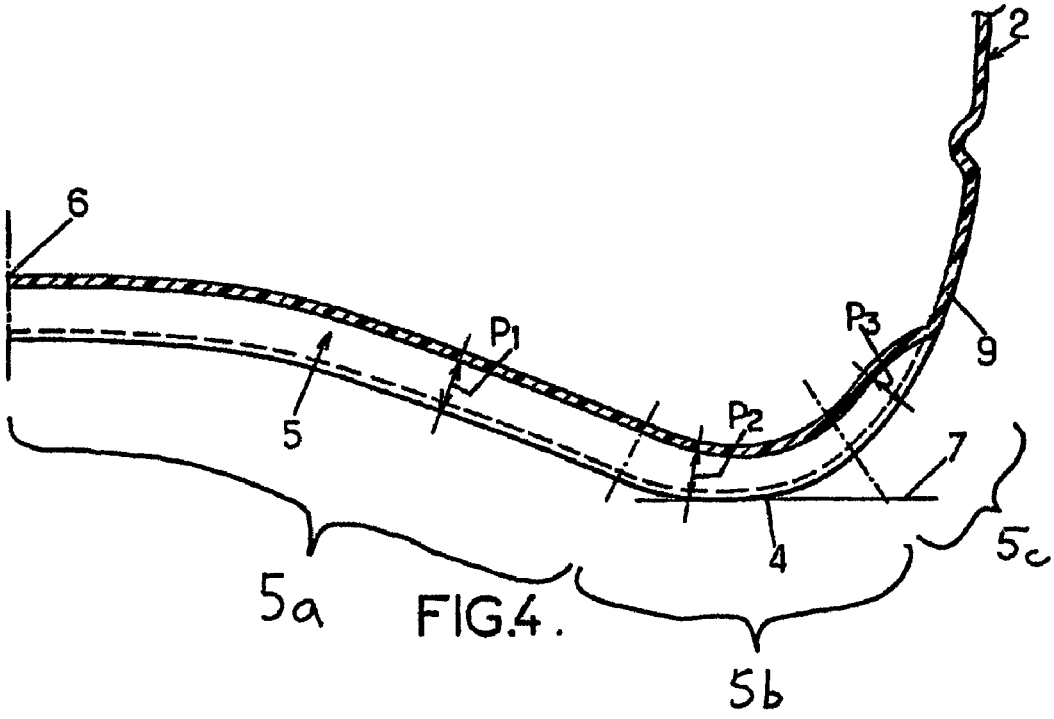
FIG. 4 is a schematic view in cross section along the line IV-IV of FIG. 2.

As represented in FIG. 4, each groove 5 comprises three portions: a first portion 5*a*, a second portion 5*b*, and a third portion 5*c*. The first portion 5*a* extends from approximately the center of the dome to approximately the annular seating 4. The second portion 5*b* extends through the annular seating 4. The third portion 5*c* extends approximately from the annular seating 4 onto the shoulder 9. The first portion has a depth p1 which is substantially constant. The second portion 5*b* has a depth p2 which is slightly reduced in its part of maximum width in touch with the seating 4. The third portion 5*c* has a depth p3 which gradually decreases in its end part on the heel 9 of the base 3.

The invention claimed is:

1. A thermoplastic container manufactured by blow molding or stretch-blow molding a heated preform, this container being intended to contain a still liquid;

wherein said container has a base comprising:

a concave dome with an outward-facing concavity;

a substantially planar peripheral annular seating provided around said concave dome and adapted for the container to rest on a support;

several grooves radiating from a central region of said concave dome and intersecting said annular seating;

wherein each groove, in a region of each groove that intersects with the annular seating, has a portion of increased width;

wherein each groove, in the portion of increased width, has two edges which are curved with relatively large radii of curvature and with respective concavities facing each other; and wherein each groove has:

a depth ($p_1$) which is substantially constant from the central region of the concave dome as far as approximately the portion of the groove having an increased width;

a depth ($p_2$) which is reduced in the portion of the groove having an increased width; and a depth ($p_3$) which gradually decreases on a heel of the base.

2. The container as claimed in claim 1, wherein an outer end of the portion of increased width extends as far as onto the heel of the base.

3. The container as claimed in claim 1, wherein the two curved edges approach one another on an outer side of the container at an acute angle.

4. The container as claimed in claim 1, wherein a portion of each groove, located between the central region of the concave dome and the portion of increased width, has a variable width; and wherein the edges of the portion located between a center of the base and the portion of increased width are curves possessing respective convexities facing in the direction of one another.

5. The container as claimed in claim 4, wherein the edges of the portion located between the central region of the concave dome and the portion of increased width join up continuously and smoothly with the respective edges of the portion of increased width.

6. The container as claimed in claim 1, wherein a dimensional ratio of the widest portion to a narrowest portion of each groove is between 1.5 and 2.5.

7. The container as claimed in claim 6, wherein the dimensional ratio is approximately 2.

8. The container as claimed in claim 1, wherein the base has a round general shape, and wherein the grooves extend radially from the central region of the concave dome to a periphery of the base.

9. The container as claimed in claim 1, wherein the portion of increased width first increases in width and then decreases in width along a radius of the base that is aligned with the groove.

10. A thermoplastic container manufactured by blow molding or stretch blow molding a heated preform wherein a base of the container comprises:

a substantially planar peripheral annular seating;

a concave dome formed between inner edges of the annular seating with the concavity facing outwards; and a plurality of grooves each with a varying width defined by two curvilinear edges;

wherein each groove extends radially from a central region of the dome through the annular seating to a periphery of the base;

wherein each groove comprises three portions:

a first portion located between the central region of the dome and the annular seating;

a second portion that intersects the annular seating; and a third portion located between the annular seating and the outer periphery of the base;

wherein the second portion of each groove has an increased width with respect to the first and third portions of each groove;

wherein the portions of the two edges that define the second portion of each groove are curved with respective concavities facing each other; and wherein each groove has a depth which is substantially constant through the first portion, a decreased depth in the second portion with respect to the first portion, and a depth that gradually decreases to zero in the third portion.

11. The container as claimed in claim 10, wherein the third portion extends onto a heel of the base;

wherein the heel of the base is defined as a portion of the base that is curved upward to connect to a body of the container.

12. The container as claimed in claim 11, wherein the portions of the two curved edges that define the third portion connect to one another on the heel of the container to form an acute angle.

13. The container as claimed in claim 10, wherein the first portion has a variable width; and wherein the portions of the two edges that define the first portion are curved with respective convexities facing each other.

14. The container as claimed in claim 10, wherein a dimensional ratio of a maximum width of the second portion to a minimum width of the first portion of each groove is between 1.5 and 2.5.

15. The container as claimed in claim 14, wherein the dimensional ratio is approximately 2.

16. The container as claimed in claim 10, wherein the base has a generally round shape.

17. The container as claimed in claim 10, wherein the majority of the surface area of the annular seating is configured to be in contact with a surface that the container is rested on.

18. The container as claimed in claim 10, wherein the second portion first increases in width and then decreases in width when traveling along a radius of the base that is aligned with the groove.

* * * * *